United States Patent [19]

Adler

[11] 4,444,238

[45] Apr. 24, 1984

[54] INSECT PROTECTION FOR OPENINGS OF BUILDINGS

[76] Inventor: Leopold Adler, Rudolf Kassnerg. 18a, A-1190 Vienna, Austria

[21] Appl. No.: 386,844

[22] Filed: Jun. 9, 1982

[51] Int. Cl.[3] ..... E06B 9/262

[52] U.S. Cl. ..... 160/84 R

[58] Field of Search ..... 160/84 R, 14, DIG. 7, 160/DIG. 1, DIG. 2; 428/181; 2/211; 24/177, 178

[56] References Cited

U.S. PATENT DOCUMENTS

| | | | |
|---|---|---|---|
| 1,515,795 | 11/1924 | Search | 160/84 R |
| 1,959,137 | 5/1934 | Miller | 160/84 R |
| 2,333,618 | 11/1943 | Strauss | 160/DIG. 7 |
| 2,635,685 | 4/1953 | Liebhaber | 160/84 R |
| 3,381,310 | 5/1968 | Tesoro et al. | 428/181 |

FOREIGN PATENT DOCUMENTS

| | | | |
|---|---|---|---|
| 181543 | 6/1922 | United Kingdom | 160/84 |

*Primary Examiner*—Peter M. Caun
*Assistant Examiner*—Cherney S. Lieberman
*Attorney, Agent, or Firm*—Townsend and Townsend

[57] ABSTRACT

An insect protector for an opening in a building comprising a net material of greater dimension than the opening, permanently creased in the horizontal direction, draw cords operating through vertically disposed openings in the net to fold and to extend the net protector, a rod secured to the lower edge of the protector, and means to hold the excess length of the net protector against the lower rod in the extended position.

5 Claims, 6 Drawing Figures

INSECT PROTECTION FOR OPENINGS OF BUILDINGS

BACKGROUND AND SUMMARY OF THE INVENTION

The invention refers to an insect protection for openings of buildings, in particular for windows.

It is already known to close openings of buildings, in particular windows, with a net for preventing insects such as flys, mosquitos, wasps and so on from entering the building through the opening of the building. This net is frequently fastened on a rigid frame which can be applied in front the opening of the building. Such an insert protection is effective when carefully mounted but can not be used everywhere and for example can not be used at those places where the opening of the building is only difficultly accessible or where the outer side of such openings is given a profile, for example by window drips, casings or the like.

There is also known an insect protection which can be lowered in front of the opening of the building like a curtain. For reliably hindering insects from entering the building, the lateral edges of the curtain must, after having lowered same, sealingly be pressed against the face of the building and maintained in this position. This does not only require separate fastening means but makes it also necessary to use these fastening means which requires additional work.

Another known embodiment is designed as a rolling window curtain which in wound-up condition is accommodated within a casing built into the window lintel, guide rails being provided at the lateral side surfaces of the window lintel within which the rolling window curtain can be pulled down in a sealing condition. Such an embodiment is not only very expensive but also reduces the effective width of the window opening so that such guide rails can not be mounted at any place, particularly if they represent an obstacle for completely opening the wings of a window.

It is an object of the present invention to provide an insect protection for openings of buildings in which the drawbacks of known constructions are avoided. It is a further object of the invention to design an insect protection for openings of buildings such that these buildings openings can reliably and in a simple manner and with low expenditure be sealed against the ingress of insects. It is a further object of the invention to design the insect protection such that it can universally be applied and can be used independent from the type of the building openings to be sealed and from protrusions or the like provided on buildings. It is a still further object of the invention to design an insect protection such that it provides an unobjectionable sealing against flying insects independent from whether exact size standards have been met or not even with uneven bordering surfaces of the building openings. It is a further object of the invention to design an insect protection such that it occupies only little space when retracted toward one edge of the opening so that in this position of the insect protection the passage of light and air through the building opening is not reduced or reduced to a negligible extent. It is a further object of the invention to provide an insect protection which can in a simple manner be moved from a first position exposing the building opening into a second position closing the building opening. Finally, it is an object of the invention to design an insect protection such that any ingress of insects through the building opening is also prevented in case of wind and storm.

It is, finally, also an object of the invention to provide a progress for manufacturing such an insect protection in a simple manner.

BRIEF DESCRIPTION OF THE DRAWINGS

In the following the invention is described with reference to the annexed drawings showing an embodiment of the invention.

DETAILED DESCRIPTION OF THE DRAWINGS

Figure 1:
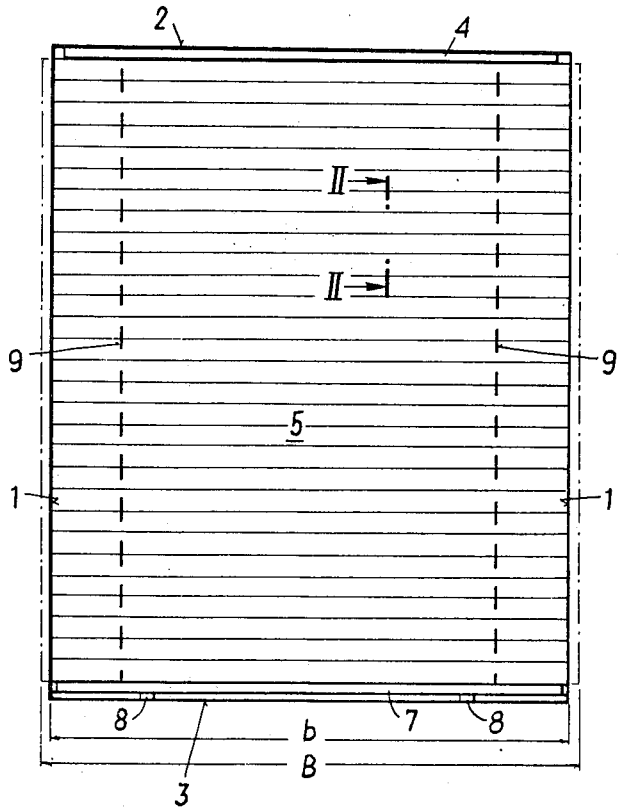
FIG. 1 shows in a front elevation an opening of a building being closed by an insect protection according to the invention.
Figure 2:
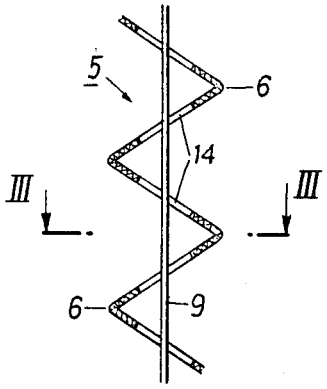
FIG. 2 shows in an enlarged scale a section along line II—II of FIG. 1.
Figure 3:
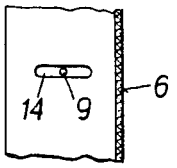
FIG. 3 is a section along line III—III of FIG. 2.

According to the embodiment shown in the drawing, an opening of a building shall be tightly closed to insects but remain permeable to light and air. The building opening has a rectangular cross section which is limited by the window embrasure defined by two side surfaces 1, the lintel 2 and the parapet 3. A head rail 4 is fixed to the lintel 2 or inserted into this lintel and carries a flexible net 5 consisting of a weather-proof and corrosion-resistant material particularly of a glass fibre fabric. This net 5 is folded in a zig-zag manner and the folding edges 6 have, in the embodiment shown a distance of approximately 40 mm one from the other. This net tightly closes the opening of the building in its stretched position (FIG. 1). For this purpose the width B (FIG. 1) of the net 5 is slightly greater than the width b (inside width) of the building opening, i.e. slightly greater than the distance of both side surfaces 1 of the window frame or the window embrasure. This causes the net 5 along the side surfaces 1 to slide to tightly contact these side surfaces 1 so that there results a complete tightness for flying ingressing insects. The bottom edge of the net 5 has connected thereto a stabilizing rod 7 which can be fixed to the parapet 3 by adhering means comprised of spring-loaded catches, press-studs 8 or the like. This also prevents the net 5 from being moved out of the building opening, for example by the pressure of incoming wind or draught, which would detract from the mentioned tightness.

Figure 4:
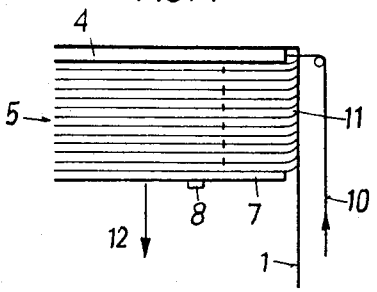
FIG. 4 shows the upper edge of the building opening for the beginning downward movement of the net from its first position, in which it leaves uncovered a portion of the building opening into its second position, in which it seals off the building opening.
Figure 5:
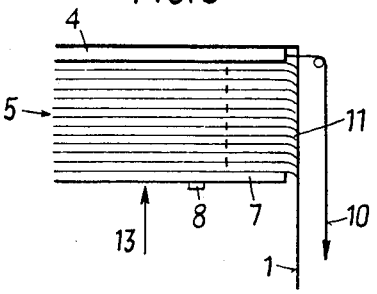
FIG. 5 equally shows the upper edge of the building opening, but in this case during upward movement of the net.

Within the building opening or within the window frame, the net 5 can be reciprocated between a zig-zag folded position (FIGS. 4 to 5), in which the net at least partially exposes the building opening, and a stretched position (FIG. 1), in which the net closes the building opening, and for this purpose are provided two or more traction cords 9 at the area of the lateral edges of the net 5, the bottom ends of the traction cords being fixed to the stabilizing rod 7. Furthermore the traction cords are passed upward through the head rail 4 and further, in a manner known per se, to a common traction member 10

(FIGS. 4,5) which can be arrested in any desired manner and in a manner known per se in the zig-zag folded position of the upwardly pulled net 5. From this position, the net 5 can be lowered under its own weight and under the influence of the weight of the stabilizing rod 7 in direction of the arrow 12 (FIG. 4) and during this movement of the net its longitudinal edges 11 become upwardly bent due to frictional adherence to the side surfaces 1 (FIG. 4) and the elastic flexibility of the net 5. When pulling the net 5 from its stretched position in upward direction into the zig-zag folded position (exposing the building opening) in direction of arrow 13 of FIG. 5, the lateral longitudinal edges 11 of the net 5 slide along the side surfaces 1 and bend downward. To prevent contact of the stabilizing rod with the side surfaces 1 of the building opening during its vertical motion, the length of the stabilizing rod 7 is smaller than the inside width b of the building opening. This further permits the net to be adapted to the existing width of the building opening.

The traction cords 9, preferably consisting of terylene, are passed through openings 14 of the net 5, said openings being formed of elongated slots having a length of approximately 5 mm the longitudinal axes of which (as seen in the stretched position of the net 5 shown in FIG. 1) extend vertically. These openings 14 are provided between two adjacent folding edges 6 of the net in a number corresponding to the number of the tension cords 9 and of such dimension that the tension cords 9 pass therethrough as snugly as possible so that insects can not enter through the remaining gap.

Figure 6:
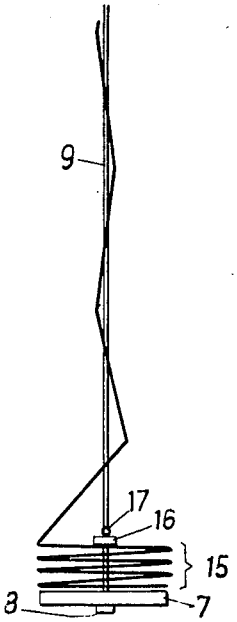
FIG. 6 illustrates a type of fastening the lower edge of the net in a side elevation.

The net 5 folded in a zig-zag manner like a jalousie shall also be designed such that it can universally be used within a wide range of heights of the building opening. For this purpose, the lower portion 15 (FIG. 6) comprising the excess length of the net 5 is secured in tightly folded position by limiting stops which force the excess length against the stabilizing rod. These limiting stops are formed of slotted punched discs 16 which are shifted onto the tension cords 9 and held in position by knots 17 of these tension cords 9.

The net consists of a glass fibre fabric having its folding edges fixed by a sizing operation. For this purpose, the glass fibre net is coated with a compound fixing the net meshes, particularly with a liquid synthetic plastics material on a vinyl base and subsequently fixed by accordion pleating under the action of heat and steam.

What I claim is:

1. Insect protection for an opening in a building, said opening being defined by a pair of substantially vertical side boundary surfaces, an upper boundary surface and a lower boundary surface, said protection comprising:

a net of elastic weather-resistant and corrison-resistant material placed within said opening and provided with permanent horizontal creases, said net adapted for vertical motion between a first position in which said net is folded at said creases in zig-zag configuration to at least partially expose said opening, and a second substantially stretched position in which said net substantially seals said opening, the width of said net when in non-deformed condition being greater than the width of said opening so that the lateral edges of said net are compressed between said vertical side boundary surfaces;

a horizontal stabilizing rod fixed to the lower edge of said net, the length of said rod being less than the width of said opening;

a pair of traction cords for moving said net upward and downward between said first and second positions, each such cord extending upward through a series of vertically disposed openings in said net, one such opening being situated between each such pair of adjacent creases and the lower end of each such cord being secured to said stabilizing rod; and means for securing in tightly folded configuration the excess length of said net to permit adjustment of the stretched length of said net to the height of said building opening.

2. Insect protection according to claim 1 wherein said openings are elongated slots, the longitudinal axes of which extend vertically when said net is in said stretched position.

3. Insect protection according to claim 1 wherein said securing means are comprised at slotted discs, through the slots of which said traction cords are passed, said discs being maintained in position by knots in said traction cords.

4. Insect protection according to claim 1 further comprising means for adhering said stabilizing rod to said lower boundary surface of said building opening to secure said net in said stretched position substantially sealing said opening.

5. Insect protection according to claim 1 wherein said net material is glass fibre fabric coated with synthetic plastics material.

* * * * *